US006076783A

United States Patent [19]

Card

[11] Patent Number: 6,076,783

[45] Date of Patent: Jun. 20, 2000

[54] BAG HOLDING DEVICE

[76] Inventor: Glen J. Card, #17-2880 Dacre Ave., Coquitlam B.C., Canada, V3C 4H6

[21] Appl. No.: 09/244,407

[22] Filed: Feb. 4, 1999

[51] Int. Cl.[7] ..... B65B 67/04

[52] U.S. Cl. ..... 248/99; 220/403; 248/100; 248/315; 383/33

[58] Field of Search ..... 248/99, 100, 95, 248/97, 101, 315, 309.2; 383/33, 12; 220/403, 404; 224/660, 663, 661

[56] References Cited

U.S. PATENT DOCUMENTS

| | | | |
|---|---|---|---|
| 2,531,058 | 11/1950 | Kralovic | 248/97 |
| 2,991,031 | 7/1961 | Sederquist | 248/99 |
| 4,702,445 | 10/1987 | Ivory | 248/100 |
| 4,878,762 | 11/1989 | Uddo, Jr. et al. | 383/33 |
| 4,919,546 | 4/1990 | Imazeki et al. | 383/33 |
| 5,160,062 | 11/1992 | Strawder | 220/404 |
| 5,349,710 | 9/1994 | Dunn | 248/99 X |

FOREIGN PATENT DOCUMENTS

| | | | |
|---|---|---|---|
| 0052801 | 2/1990 | Japan | 248/99 |

*Primary Examiner*—Ramon O. Ramirez
*Assistant Examiner*—Tan Le

[57] ABSTRACT

A bag holding device for holding the mouth of a bag open and attaching to a belt of a user. The bag holding device includes a open ring with a plurality of spaced apart fastening holes therearound. Inserted into each fastening hole is a plug. An elongate handle outwardly extends from the outer perimeter of the ring. The handle has a resilient flexible portion at which the handle is bendable.

15 Claims, 3 Drawing Sheets

BAG HOLDING DEVICE

BACKGROUND OF THE INVENTION

1. Field of the Invention

The present invention relates to bag holding devices and more particularly pertains to a new bag holding device for holding the mouth of a bag open and attaching to a belt of a user.

2. Description of the Prior Art

The use of bag holding devices is known in the prior art. More specifically, bag holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,395,022 by Vandewall; U.S. Pat. No. 1,565,118 by Stugard; U.S. Pat. No. 4,836,428 by Evans et al.; U.S. Pat. No. 4,919,546; U.S. Pat. No. 3,991,961 by Platzer, Jr.; and U.S. Pat. No. Des. 326,752 by Griggs.

While these devices fulfill their respective, particular objectives and requirements, the aforementioned patents do not disclose a new bag holding device. The inventive device includes a open ring with a plurality of spaced apart fastening holes therearound. Inserted into each fastening hole is a plug. An elongate handle outwardly extends from the outer perimeter of the ring. The handle has a resilient flexible portion at which the handle is bendable.

In these respects, the bag holding device according to the present invention substantially departs from the conventional concepts and designs of the prior art, and in so doing provides an apparatus primarily developed for the purpose of holding the mouth of a bag open and attaching to a belt of a user.

SUMMARY OF THE INVENTION

In view of the foregoing disadvantages inherent in the known types of bag holding devices now present in the prior art, the present invention provides a new bag holding device construction wherein the same can be utilized for holding the mouth of a bag open and attaching to a belt of a user.

The general purpose of the present invention, which will be described subsequently in greater detail, is to provide a new bag holding device apparatus and method which has many of the advantages of the bag holding devices mentioned heretofore and many novel features that result in a new bag holding device which is not anticipated, rendered obvious, suggested, or even implied by any of the prior art bag holding devices, either alone or in any combination thereof.

To attain this, the present invention generally comprises a open ring with a plurality of spaced apart fastening holes therearound. Inserted into each fastening hole is a plug. An elongate handle outwardly extends from the outer perimeter of the ring. The handle has a resilient flexible portion at which the handle is bendable.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag holding device apparatus and method which has many of the advantages of the bag holding devices mentioned heretofore and many novel features that result in a new bag holding device which is not anticipated, rendered obvious, suggested, or even implied by any of the prior art bag holding devices, either alone or in any combination thereof.

It is another object of the present invention to provide a new bag holding device which may be easily and efficiently manufactured and marketed.

It is a further object of the present invention to provide a new bag holding device which is of a durable and reliable construction.

An even further object of the present invention is to provide a new bag holding device which is susceptible of a low cost of manufacture with regard to both materials and labor, and which accordingly is then susceptible of low prices of sale to the consuming public, thereby making such bag holding device economically available to the buying public.

Still yet another object of the present invention is to provide a new bag holding device which provides in the apparatuses and methods of the prior art some of the advantages thereof, while simultaneously overcoming some of the disadvantages normally associated therewith.

Still another object of the present invention is to provide a new bag holding device for holding the mouth of a bag open and attaching to a belt of a user.

Yet another object of the present invention is to provide a new bag holding device which includes a open ring with a plurality of spaced apart fastening holes therearound. Inserted into each fastening hole is a plug. An elongate handle outwardly extends from the outer perimeter of the ring. The handle has a resilient flexible portion at which the handle is bendable.

Still yet another object of the present invention is to provide a new bag holding device that holds a bag to the belt of a user to leave the user's hands free to perform other tasks.

Even still another object of the present invention is to provide a new bag holding device that holds the mouth of a bag open at a position where it is easy for a user to place items in the bag with their hands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
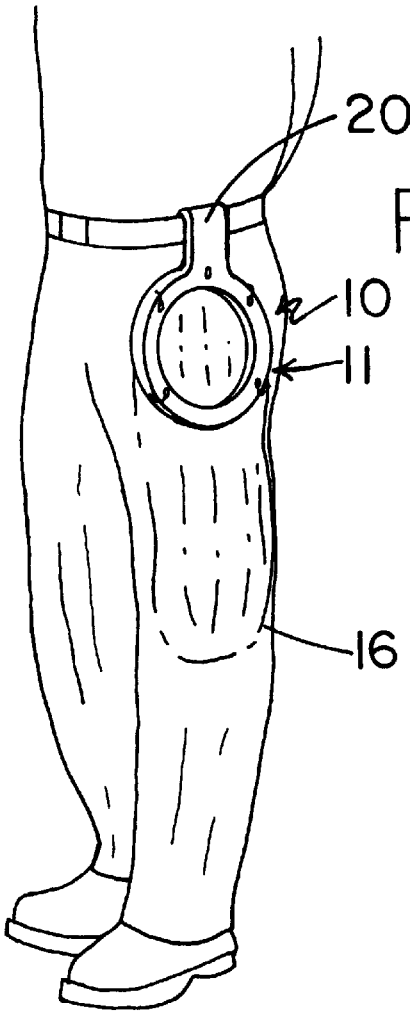
FIG. 1 a schematic perspective view of a new bag holding device in use on the belt of a user according to the present invention.

With reference now to the drawings, and in particular to FIGS. 1 through 6 thereof, a new bag holding device embodying the principles and concepts of the present invention and generally designated by the reference numeral 10 will be described.

As best illustrated in FIGS. 1 through 6, the bag holding device 10 generally comprises a open ring with a plurality of spaced apart fastening holes therearound. Inserted into each fastening hole is a plug. An elongate handle outwardly extends from the outer perimeter of the ring. The handle has a resilient flexible portion at which the handle is bendable.

In closer detail, the bag holding device 10 a generally circular open ring 11 has a pair of annular faces 12,13, and generally circular concentric inner and outer perimeters 14,15. The inner perimeter of the ring defines a generally circular central opening through the ring. Preferably, the faces of the ring lie in substantially parallel planes to one another. Preferably, the ring has a generally rectangular transverse cross section such that portions of the transverse cross section of the ring formed by the inner and outer perimeters of the ring are substantially parallel to one another and substantially perpendicular to portions of the transverse cross section of the ring formed by the faces of the ring. Ideally, the ring has a thickness defined between the faces of the ring of about ¼ inch and an inner diameter defined by the inner perimeter between about 6 inches and bout 9 inches. In this ideal embodiment, the ring has a width defined between the inner and outer perimeters of about 1¼ inches.

Figure 4:
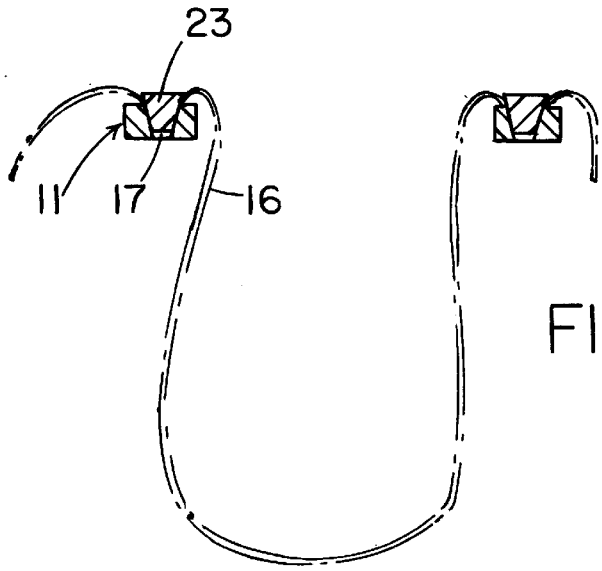
FIG. 4 is another schematic cross sectional view of the present invention illustrating the positioning of a flexible bag.

In use, the bad holding device is designed for holding a mouth of a flexible bag 16 which provides an opening into the bag. With particular reference to FIG. 4, the bag is extended through the central opening of the ring. The mouth of the bag is folded or draped over a first of the faces of the ring such that the mouth of the bag is open and an outer periphery of the mouth of the bag is extended around the ring. The remainder of the bag is extended from the central opening of the ring in an outwards direction from a second of the faces of the ring.

Figure 3:
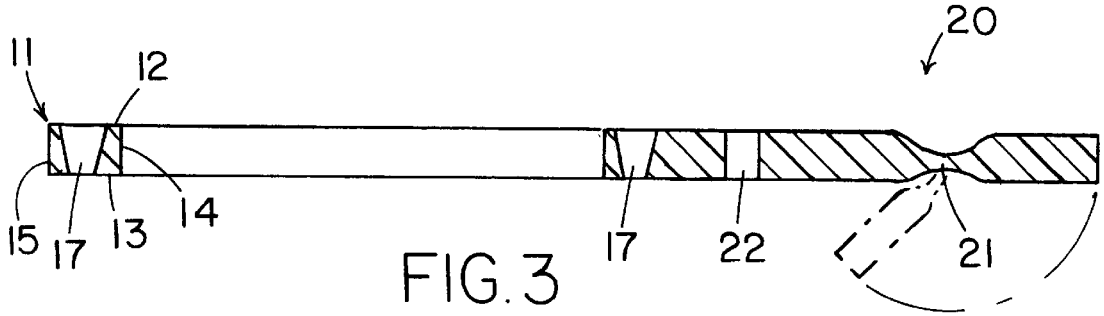
FIG. 3 is a schematic cross sectional view of the present invention taken from line 3—3 of FIG. 2.

The bag is coupled to the ring along the first face of the ring to hold the mouth of the bag open so that items may be easily stuffed into the bag. Preferably, the ring has a plurality of spaced apart fastening holes 17 extending therethrough between the faces of the ring. As illustrated in FIG. 3, preferably, the fastening holes each are generally frusto-conical in shape and taper in a direction from the first face of the ring towards the second face of the ring. Ideally, the fastening holes are spaced apart at generally equal intervals along the ring.

Figure 5:
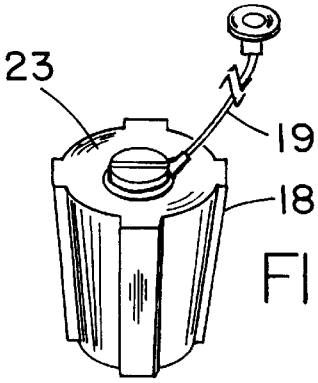
FIG. 5 is a schematic enlarged perspective view of a plug.

The bag holding device further comprises a plurality of plugs 23. As depicted in FIG. 4, each plug is inserted into an associated fastening hole from the first face of the ring such that a portion of the bag is extended into each fastening hole and positioned between the ring and the plugs so that the plugs hold the bag to the ring with the mouth of the bag open. Preferably, as illustrated in FIG. 5, the plugs each are generally frusto-conical in shape and have a plurality of spaced apart outwardly extending longitudinal ribs 18. The plugs also preferably comprise a resiliently deformable material so that the plugs slightly deform when inserted into their associated fastening hole to help hold the respective plug therein. Each of the plugs preferably has an elongate flexible member 19 (such as a flexible cable or string) coupled thereto. The flexible members each have an end opposite the associated plug coupled to the outer perimeter of the ring adjacent the fastening hole associated with the associated plug.

An elongate handle 20 outwardly extends from the outer perimeter of the ring. The handle has a pair of faces, opposite proximal and distal ends, and a longitudinal axis extending between the proximal and distal ends of the handle. The proximal end of the handle is integrally coupled to the outer perimeter of the ring with the longitudinal axis of the handle preferably extending radially outwards from the ring. One of the faces of the handle and one of the faces of the ring lie in a common plane with one another while the other of the faces of the handle and the other of the faces of the ring lie in a common plane with one another. The handle preferably has a generally rectangular transverse cross section taken substantially perpendicular to the longitudinal axis of the handle with essentially equal dimensions to the transverse cross section of the ring. Ideally, the handle has a length defined between the ends of the handle between 4 inches and about 7 inches.

Figure 2:
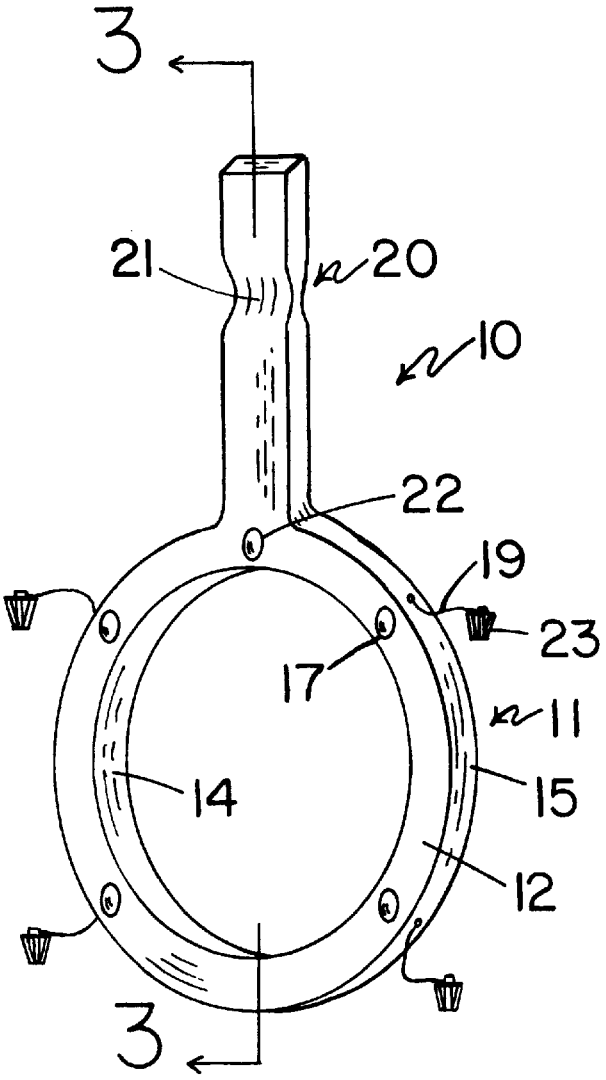
FIG. 2 is a schematic perspective view of one embodiment of the present invention.
Figure 6:
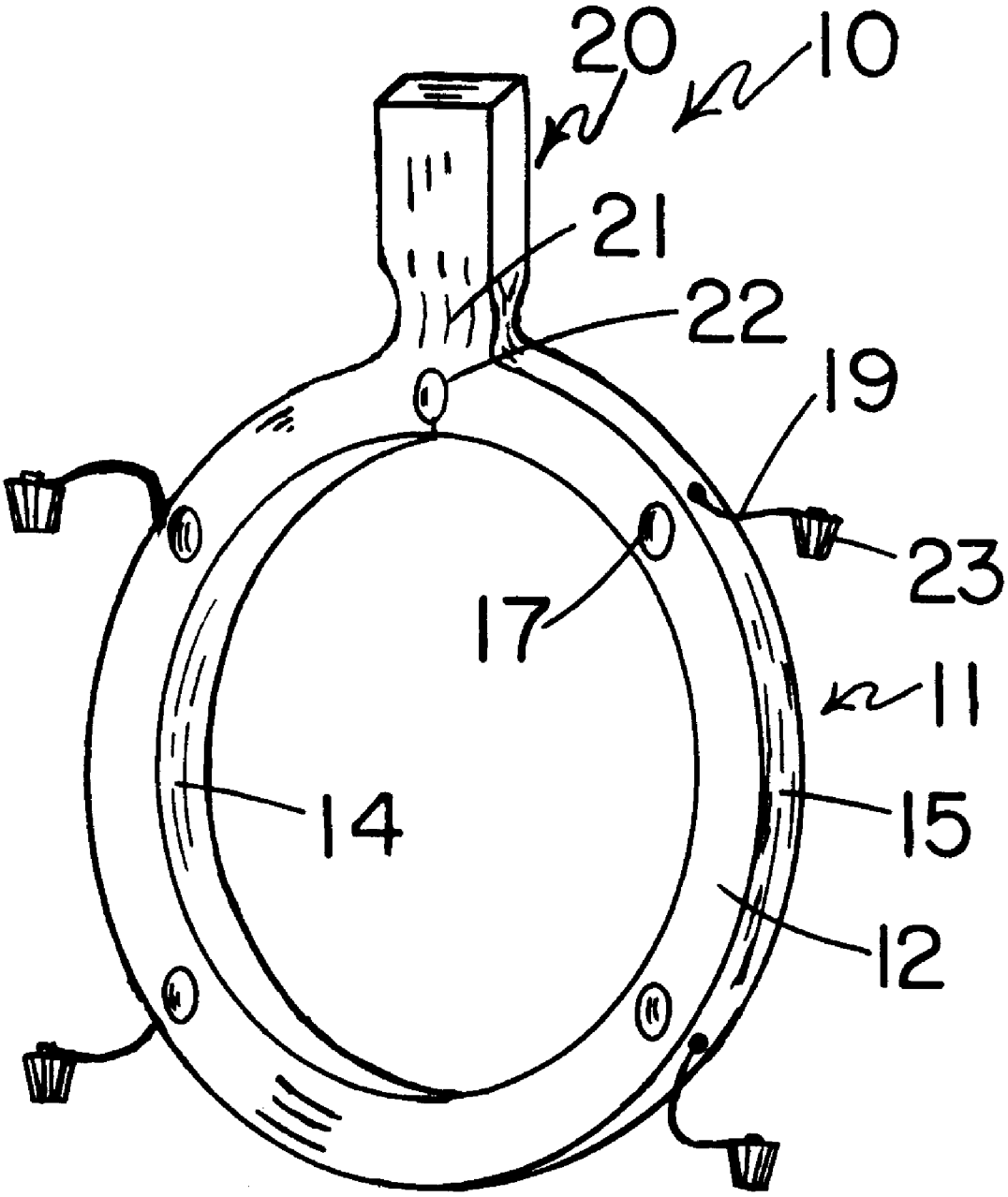
FIG. 6 is a schematic perspective view of a preferred embodiment of the present invention.

The handle has a resilient flexible portion 21, that ideally comprises a living hinge formed by a pinched region in the handle where the thickness of the handle defined between the faces of the handle is reduced. With reference to FIG. 2, in one embodiment, the flexible portion is positioned between and spaced apart from proximal and distal ends of the handle. In another preferred embodiment, as illustrated in FIG. 6, the flexible portion is positioned adjacent the outer perimeter of the ring. As illustrated in FIGS. 3 and 1, the handle is bent at the flexible portion and hooked over a belt of a user such that the ring depends from the belt of the user.

In the embodiment illustrated in FIG. 2, the handle preferably has a generally circular hanging hole 22 therethrough between the faces of the handle. The hanging hole is positioned between the proximal end and the flexible portion of the handle. In the embodiment illustrated in FIG. 6, the hanging hole is located in the ring adjacent the handle. In use, the hanging hole is designed for hanging the bag holder on a hook.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag holding system comprising:

a open ring having a pair of faces, and generally inner and outer perimeters, said inner perimeter of said ring defining a central opening through said ring;

said ring having a plurality of spaced apart fastening holes;

a plurality of plugs, each plug being inserted into an associated fastening hole;

an elongate handle outwardly extending from said outer perimeter of said ring;

said handle having a resilient flexible portion; and wherein said plugs each are generally frusto-conical in shape and have a plurality of spaced apart outwardly extending longitudinal ribs.

2. The bag holding device of claim 1, further comprising a flexible bag having a mouth providing an opening therein, said bag being extended through said central opening of said ring, said mouth of said bag being folded over a first of said faces of said ring such that said mouth of said bag is open and an outer periphery of said mouth of said bag is extended around said ring, a remainder portion of said bag being extended from said central opening of said ring in an outwards direction from a second of said faces of said ring, a portion of said bag being extended into each fastening hole and positioned between said ring and said plugs so that said plugs hold said bag to said ring.

3. The bag holding device of claim 1, wherein said plugs comprise a resiliently deformable material.

4. The bag holding device of claim 1, wherein each of said plugs has an elongate flexible member coupled thereto, said flexible members each having an end opposite the associated plug coupled to said ring.

5. The bag holding device of claim 1, wherein said handle has opposite proximal and distal ends, said proximal end of said handle being coupled to said outer perimeter of said ring.

6. The bag holding device of claim 5, wherein said flexible portion is positioned between and spaced apart from proximal and distal ends of said handle.

7. The bag holding device of claim 5, wherein said flexible portion being positioned adjacent said outer perimeter of said ring.

8. The bag holding device of claim 5, wherein said flexible portion comprises a living hinge.

9. A bag holding device system, comprising;

a flexible bag having a mouth providing an opening therein;

a bag holding device comprising:

a generally circular open ring having a pair of annular faces, and generally circular inner and outer perimeters, said inner perimeter of said ring defining a generally circular central opening through said ring;

said faces of said ring lying in substantially parallel planes to one another;

said ring having a generally rectangular transverse cross section such that portions of said transverse cross section of said ring formed by said inner and outer perimeters of said ring are substantially parallel to one another and substantially perpendicular to portions of said transverse cross section of said ring formed by said faces of said ring;

said bag being extended through said central opening of said ring;

said mouth of said bag being folded over a first of said faces of said ring such that said mouth of said bag is open and an outer periphery of said mouth of said bag is extended around said ring;

a remainder portion of said bag being extended from said central opening of said ring in an outwards direction from a second of said faces of said ring;

said ring having a plurality of spaced apart fastening holes extending therethrough between said faces of said ring;

said fastening holes each being generally frusto-conical in shape and tapering in a direction from said first face of said ring towards said second face of said ring;

said fastening holes being spaced apart at generally equal intervals along said ring;

a plurality of plugs, each plug being inserted into an associated fastening hole from said first face of said ring such that a portion of said bag is extended into each fastening hole and positioned between said ring and said plugs so that said plugs hold said bag to said ring;

said plugs each being generally frusto-conical in shape and having a plurality of spaced apart outwardly extending longitudinal ribs;

said plugs comprising a resiliently deformable material;

each of said plugs having an elongate flexible member coupled thereto, said flexible members each having an end opposite the associated plug coupled to said outer perimeter of said ring adjacent the fastening hole associated with the associated plug;

an elongate handle outwardly extending from said outer perimeter of said ring;

said handle having a pair of faces, opposite proximal and distal ends, and a longitudinal axis extending between said proximal and distal ends of said handle;

one of said faces of said handle and one of said faces of said ring lying in a common plane with one another, the other of said faces of said handle and the other of said faces of said ring lying in a common plane with one another substantially parallel to said common plane of said one face of said handle and said one face of said ring;

said handle having a generally rectangular transverse cross section taken substantially perpendicular to said longitudinal axis of said handle;

said proximal end of said handle being coupled to said outer perimeter of said ring, said longitudinal axis of said handle being extended radially outwards from said ring;

said handle having a resilient flexible portion, wherein said flexible portion comprises a living hinge;

said flexible portion being positioned adjacent said outer perimeter of said ring;

said handle being bent at said flexible portion and hooked over a belt of a user such that said ring depends from the belt of the user; and said ring having a generally circular hanging hole therethrough between said faces of said ring said hanging hole being positioned adjacent said handle.

10. A bag holding system comprising:

a open ring having a pair of faces, and generally inner and outer perimeters, said inner perimeter of said ring defining a central opening through said ring;

said ring having a plurality of spaced apart fastening holes;

a plurality of plugs, each plug being inserted into an associated fastening hole;

an elongate handle outwardly extending from said outer perimeter of said ring;

said handle having a resilient flexible portion; and wherein each of said plugs has an elongate flexible member coupled thereto, said flexible members each having an end opposite the associated plug coupled to said ring.

11. The bag holding device of claim 10, further comprising a flexible bag having a mouth providing an opening therein, said bag being extended through said central opening of said ring, said mouth of said bag being folded over a first of said faces of said ring such that said mouth of said bag is open and an outer periphery of said mouth of said bag is extended around said ring, a remainder portion of said bag being extended from said central opening of said ring in an outwards direction from a second of said faces of said ring, a portion of said bag being extended into each fastening hole and positioned between said ring and said plugs so that said plugs hold said bag to said ring.

12. The bag holding device of claim 10, wherein said handle has opposite proximal and distal ends, said proximal end of said handle being coupled to said outer perimeter of said ring.

13. The bag holding device of claim 12, wherein said flexible portion is positioned between and spaced apart from proximal and distal ends of said handle.

14. The bag holding device of claim 12, wherein said flexible portion being positioned adjacent said outer perimeter of said ring.

15. The bag holding device of claim 12, wherein said flexible portion comprises a living hinge.

* * * * *